United States Patent [19]

Shinohara

[11] 4,266,932

[45] May 12, 1981

[54] HEATING FURNACE

[75] Inventor: Yoshiaki Shinohara, Kurashiki, Japan

[73] Assignee: Kawasaki Steel Corporation, Kobe, Japan

[21] Appl. No.: 22,094

[22] Filed: Mar. 20, 1979

Related U.S. Application Data

[63] Continuation-in-part of Ser. No. 927,850, Jul. 25, 1978, Pat. No. 4,229,163.

[30] Foreign Application Priority Data

Jul. 25, 1977 [JP] Japan ..... 52-89680

[51] Int. Cl.[3] ..... F27B 7/00

[52] U.S. Cl. ..... 432/194; 432/202

[58] Field of Search ..... 432/28, 121, 122, 177, 432/178, 180, 194, 202, 148; 431/171

[56] References Cited

U.S. PATENT DOCUMENTS

| | | | |
|---|---|---|---|
| 1,477,675 | 12/1923 | Vincent | 432/194 |
| 1,710,995 | 4/1929 | McDougal | 432/194 |
| 1,948,440 | 2/1934 | Crossland | 432/194 |
| 2,117,924 | 5/1938 | Van Meter | 431/171 |
| 2,483,681 | 10/1949 | van der Neut | 432/194 |
| 2,612,263 | 9/1952 | Slavick | 432/148 |
| 2,762,618 | 9/1956 | Johnson et al. | 432/178 |
| 3,251,393 | 5/1966 | Beach et al. | 431/171 |
| 3,421,746 | 1/1969 | McCoy | 432/148 |
| 3,907,491 | 9/1975 | Morse | 432/28 |
| 4,193,761 | 3/1980 | Mantegani | 432/148 |

FOREIGN PATENT DOCUMENTS

| | | | |
|---|---|---|---|
| 2523214 | 12/1976 | Fed. Rep. of Germany | 431/171 |
| 2656798 | 7/1977 | Fed. Rep. of Germany | 431/171 |
| 502368 | 5/1920 | France | 432/194 |
| 565224 | 11/1944 | United Kingdom | 432/202 |

*Primary Examiner*—John J. Camby

*Attorney, Agent, or Firm*—Koda and Androlia

[57] ABSTRACT

A heating furnace, suitable for use in a continuous steel slab heating furnace, wherein slabs are heated by fuel combustion flames. Heat transfer converters each made of a heat-resistant material are disposed downstream of the flow of the combustion flames, more particularly, in the preheating zone of the furnace. These converters are heated through convection heat transfer from a high temperature and high speed flow of the combustion flames.

7 Claims, 34 Drawing Figures

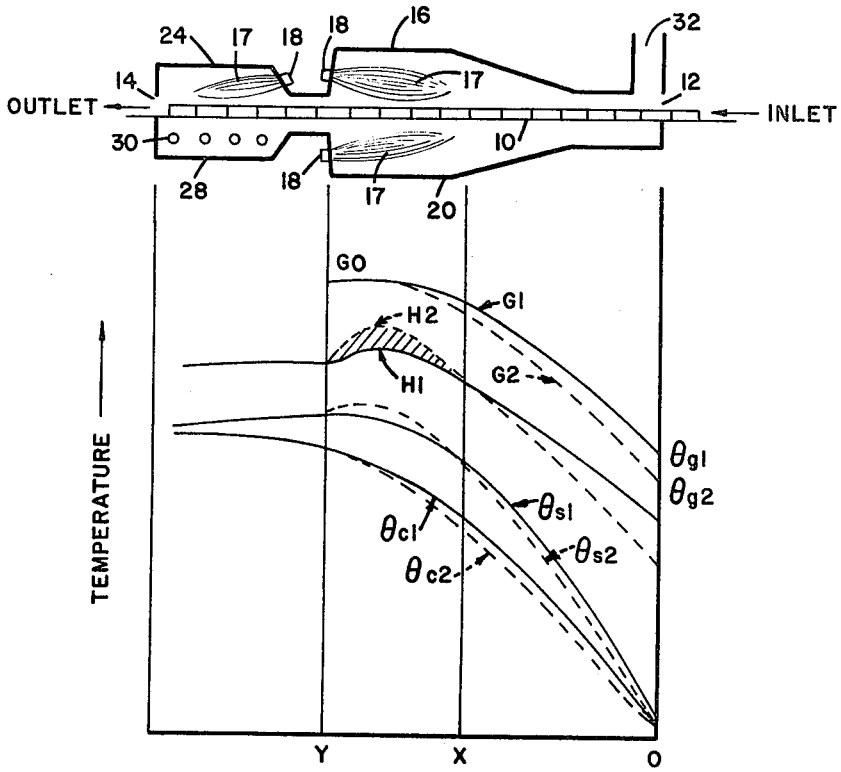
Fig. 1
PRIOR ART
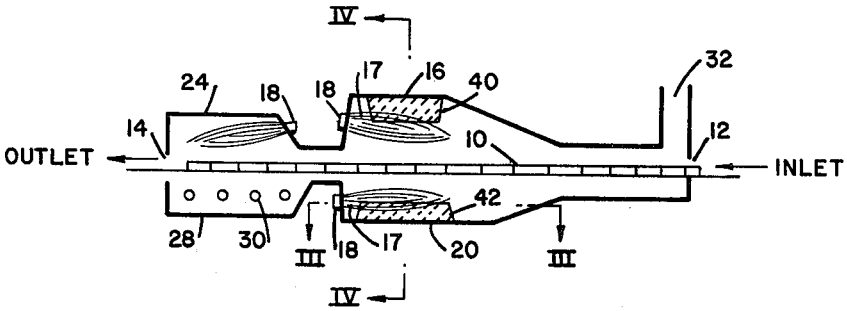
Fig. 2
Fig. 3
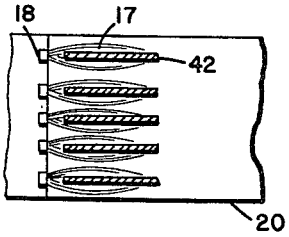
Fig. 4
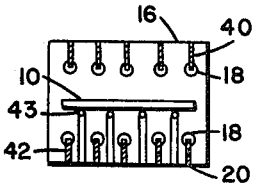

FIG. 19
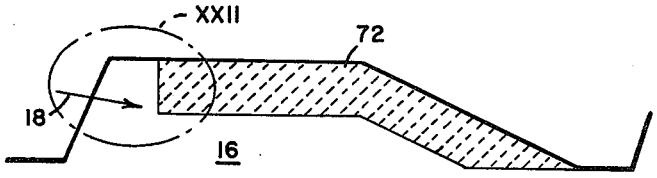
FIG. 20
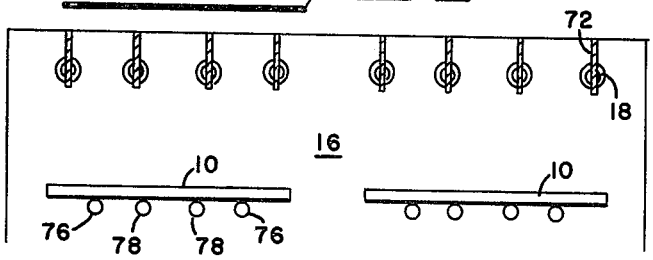
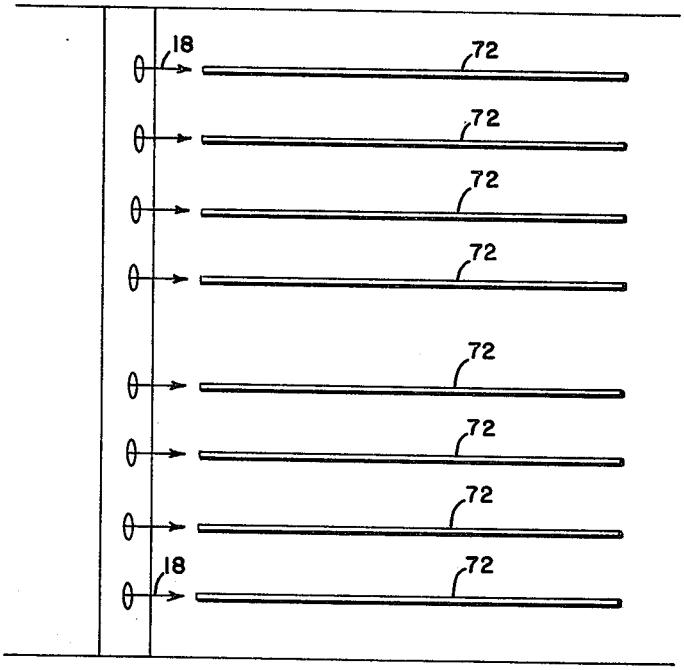
FIG. 21

Fig. 22
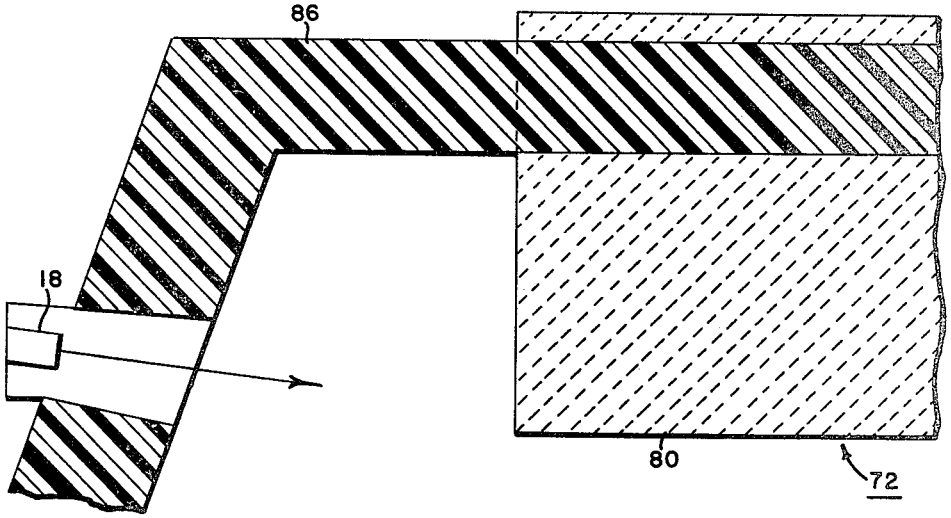
Fig. 23
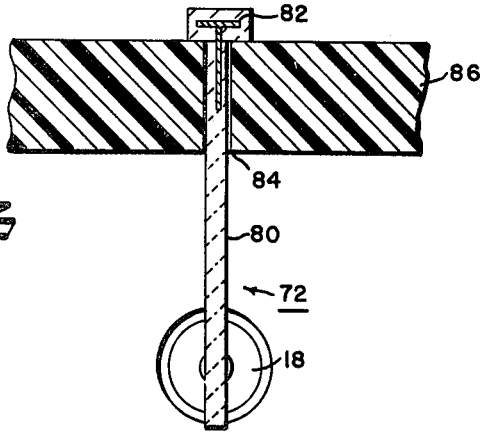
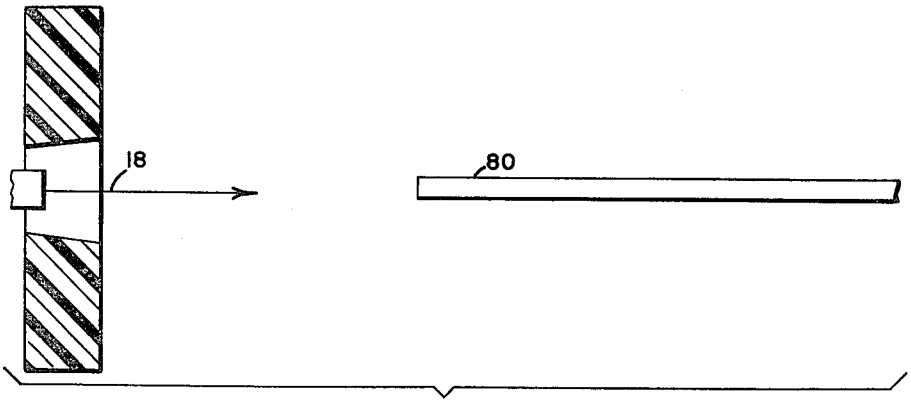
Fig. 24

FIG. 31
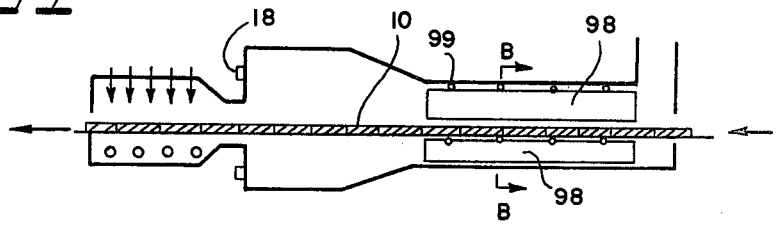
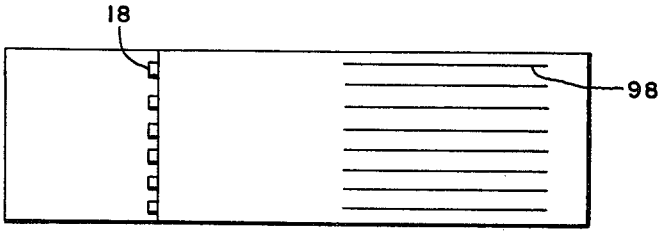
FIG. 32
FIG. 33
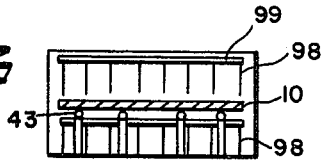
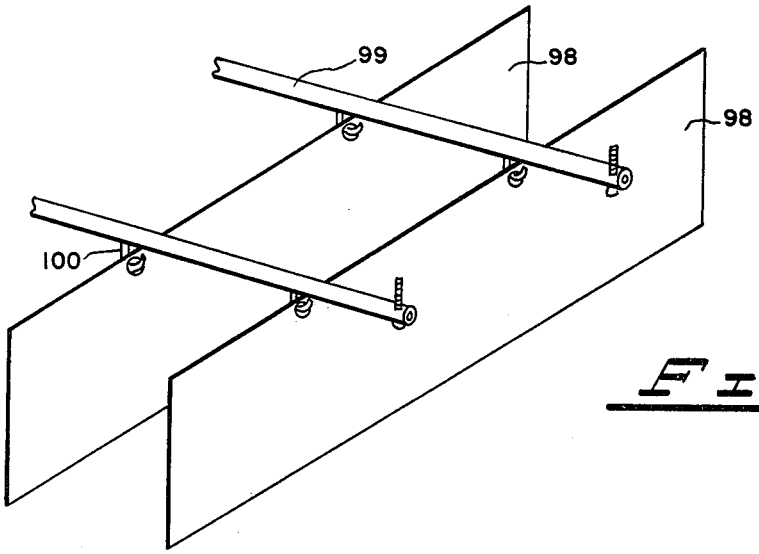
FIG. 34

HEATING FURNACE

This application is a continuation in part of U.S. application Ser. No. 927,850, filed July 25, 1978, now U.S. Pat. No. 4,229,163.

BACKGROUND OF THE INVENTION

1. Field of the Invention

The present invention relates to a heating furnace for heating bodies by fuel combustion flames, and particularly to a heating furnace suitable for use in a continuous steel slab heating furnace and having a high heat transfer efficiency for the bodies to be heated.

2. Description of the Prior Art

In a heating furnace in which bodies are heated by fuel combustion flames, particularly, in a continuous steel slab heating furnace, heat transfer to steel slabs is effected directly through radiation heat transfer and convection heat transfer from combustion gas, and indirectly through radiation heat transfer from the refractory material on the furnace wall heated through radiation and convection heat transfer from combustion gas.

An example of the conventional four-zone steel slab heating furnace as described above is shown in FIG. 1. The upper portion of the drawing shows the construction of the heating furnace, and the lower portion shows the distribution of temperature in the heating furnace. Referring to the drawing, designated at 10 are steel slabs being continuously charged through an inlet 12 for charging and sent out through an outlet 14 for extracting; 16 an upper heating zone where axial flow type burners 18 are disposed for blowing out fuel combustion flames 17 in parallel to the moving direction of the steel slabs; 20 a lower heating zone where also axial flow type burners 18 are disposed; 24 on upper soaking zone where also axial flow type burners 18 are disposed; 28 a lower soaking zone where side burners 30 are disposed for blowing out fuel combustion flames perpendicularly to the moving direction of the steel slabs; and 32 a waste gas exhaust port. Additionally, the inner wall surface of this heating furnace is entirely covered by refractory material.

Now, if steel slabs 10 each having a given value of thickness are heated under conditions that the heating load is M ton/hour; the heat pattern (wall temperature pattern) in the furnace $H_1$, and the temperature pattern of combustion gas $G_1$, then the curves of temperature rise of the steel slabs are shown by solid lines $\theta_{S1}$ (surface temperature) and $\theta_{C1}$ (center temperature) in FIG. 1. The curves of temperature rise of the steel slabs under the same conditions as above except that the heat pattern in the furnace is $H_2$ and the temperature pattern of combustion gas $G_2$ are shown by broken lines $\theta_{S2}$ (surface temperature) and $\theta_{C2}$ (center temperature) also in FIG. 1. Consequently, in a section from Point O, the inlet for charging to Point x, the inlet of heating zone, $H_1 > H_2$, $\theta_{S1} > \theta_{S2}$ and $\theta_{C1} > \theta_{C2}$, in a section from Point x described above to Point y, the outlet of heating zone, $H_1 < H_2$, $\theta_{S1} < \theta_{S2}$ and $\theta_{C1} > \theta_{C2}$, and at point y, $\theta_{S1} = \theta_{S2}$, $\theta_{C1} = \theta_{C2}$, whereby heating is effected at the same temperature in both cases. In addition, if the same fuel is used and the same excess air ratio is adopted, the temperature of combustion gas is the same, i.e. $G_0$, at the burner portion, and thereafter $G_1 > G_2$ and $\theta_{g1} > \theta_{g2}$ at Point O of the furnace end. In the heating furnace as described above, the loss of heat caused by waste gas exhausted from a waste gas exhaust port 32 disposed adjacent to the inlet for charging of the heating furnace is large. Hence, in comparison between the heat patterns $H_1$ with $H_2$, the latter has less heat loss and better thermal efficiency than the former. Consequently, with the conventional heating furnaces, the heat pattern in the furnaces have been made to be close to the heat pattern $H_2$ in designing the burners or the configurations of furnaces. However, in the case the kinds of fuel, the burners, the configurations of furnaces and the excess air ratio are the same there has not existed any means for further raising the temperature at the central portion of the heating zone.

On the other hand, heretofore, convection heat transfer from the high temperature and high speed flow of fuel combustion flames has not been positively utilized.

SUMMARY OF THE INVENTION

The present invention is intended to obviate the aforesaid disadvantages of the prior art, and the general object of the present invention is to provide a heating furnace, wherein convection heat transfer from the high temperature and high speed flow of combustion flames existing in furnace is positively utilized, whereby the temperature in the central portion of the heating furnace is high and accordingly the heat transfer efficiency is high, so that energy saving can be achieved.

Another object of the present invention is to provide various heat transfer converters suitable for use in the aforesaid heating furnace.

A further object of the present invention is to provide heat transfer converter suitable for use in the upper zone of the aforesaid heating furnace.

A still further object of the present invention is to provide heat transfer converters suitable for use in the lower zone of the aforesaid heating furnace.

The present invention achieves the aforesaid objects in a manner that, in the heating furnace for heating bodies by fuel combustion flame, at least one heat transfer converter each made of at least one heat-resistant material, which is heated through convection heat transfer from high temperature and high speed flow of combustion flame and increasing radiation heat transfer to said bodies to be heated, is disposed downstream of the flow of combustion flame, whereby the temperature of the furnace wall of the burner portions in the heating furnace can be made close to the temperature of the combustion flame, so that the heat transfer efficiency of the heating furnace can be improved without changing the kind of fuel, the configuration of the furnace, the excess air ratio and the like. Consequently, the thermal efficiency is raised by about 8–15% or more thus attaining the energy saving. Additionally, in the case the same quantity of heat is thrown in, the heating capacity is increased. Further, in the case of the side burner type wherein fuel combustion flames are disposed perpendicularly to the moving direction of the charged bodies, there is such an advantage that the flow of combustion flames can be controlled and the distribution of temperature in the width-wise direction of the furnace can be made uniform. Additionally, there are further excellent advantages that the heat transfer converter facilitate diffusion combustion, whereby combustion flame is stabilized and combustion can be effected under a lower excess air ratio so that both the energy saving and the decrease of $NO_x$ can be attained.

Further, the present invention provides various heat transfer converters suitable for use in the aforesaid heating furnace, such as a plate-like heat-resistant downstream of the flow of the flame of the burner, thin plate-like heat-resistant materials connected to one another by means of at least one bar material and paralelly disposed downstream of the flow of the flame of the burner, a plurality of coil-like heat-resistant materials poasted on the inner wall surface of the heating furnace downstream of the flow of the burner.

Still further, the present invention provides heat transfer converter made of net-like heat resistant material suspended from the ceiling.

BRIEF DESCRIPTION OF THE DRAWINGS

The above-mentioned features and objects of the present invention will become more apparent by reference to the following description taken in conjunction with the accompanying drawings, wherein like reference numerals denote like elements, and in which:

FIG. 1 is a diagram showing the construction and the distribution of temperature in the furnace of the conventional four-zone continuous steel slab heating furnace;

FIG. 2 is a sectional view showing the first embodiment of the four-zone continuous steel slab heating furnace to which the present invention is applied;

FIG. 3 is a sectional view taken along the line III—III in FIG. 2;

FIG. 4 is a sectional view taken along the line IV—IV in FIG. 2;

FIG. 19 is a sectional view showing the heat transfer converter of the upper heating zone in the third embodiment;

FIG. 20 is a front view thereof;

FIG. 21 is a plan view thereof;

FIG. 22 is an enlarged view of the part XXII in FIG. 19;

FIG. 23 is a front view thereof;

FIG. 24 is a plan view thereof;

FIG. 31 is a sectional view showing another embodiment having a plate-like converters in the preheating zone;

FIG. 32 is a plan view thereof;

FIG. 33 is a sectional view taken along the line B—B of FIG. 31; and

FIG. 34 is a perspective view of the converter shown in FIG. 31.

DETAILED DESCRIPTION OF THE INVENTION

Figure 5:
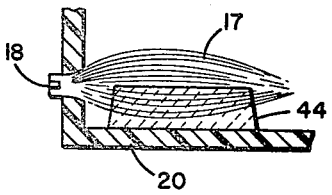
FIG. 5 is a sectional view showing the heat transfer converter in the first embodiment.

Detailed description will hereunder be given of the embodiments of the present invention with reference to the drawings. FIGS. 2 to 4 show the first embodiment of the present invention, which relates to the four-zone continuous steel slab heating furnace. This embodiment differs from the above conventional example in that heat transfer converters 40 suspending from the ceiling are arranged in five rows within combustion flames 17 of five axial flow type burners 18 paralelly provided in an upper heating zone 16, and heat transfer converters 42 projecting from the furnace floor are arranged in five rows within combustion flames 17 of five axial flow type burners 18 paralelly provided in a lower heating zone 20. Designated at 43 are skids for conveying steel slabs. Since the axial flow type burners are adopted in both upper and lower heating zones in this heating furnace, the heat transfer converters 40, 42 are provided in parallel to the moving direction of the steel slabs. The points other than the above are identical with that of the conventional example described above, and hence, description thereof is omitted.

Figure 6:
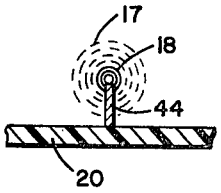
FIG. 6 is a front view thereof.
Figure 7:
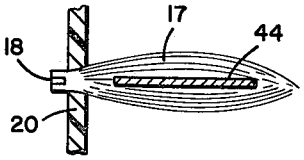
FIG. 7 is a plan view thereof.

As shown in FIGS. 5 through 7, the heat transfer converter 42 described above is plate-like heat resistant body 44 made of fiberboard, for example, disposed within and in the flow of the combustion flame 17 of the burner 18.

Figure 8:
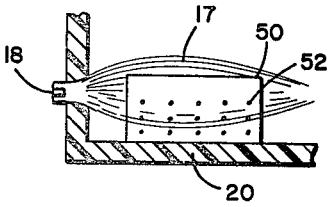
FIG. 8 is a sectional view showing a modified example of the heat transfer converter.
Figure 9:
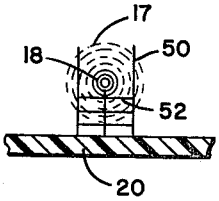
FIG. 9 is a front view thereof.
Figure 10:
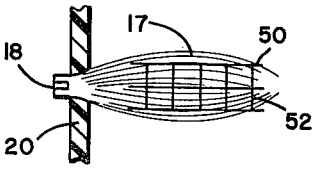
FIG. 10 is a plan view thereof.
Figure 11:
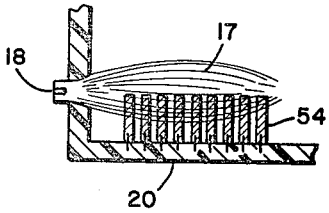
FIG. 11 is a sectional view showing another modified example of the heat transfer converter.
Figure 12:
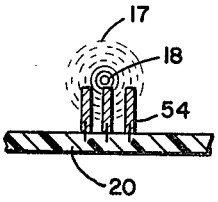
FIG. 12 is a front view thereof.
Figure 13:
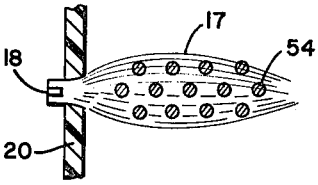
FIG. 13 is a plan view thereof.
Figure 14:
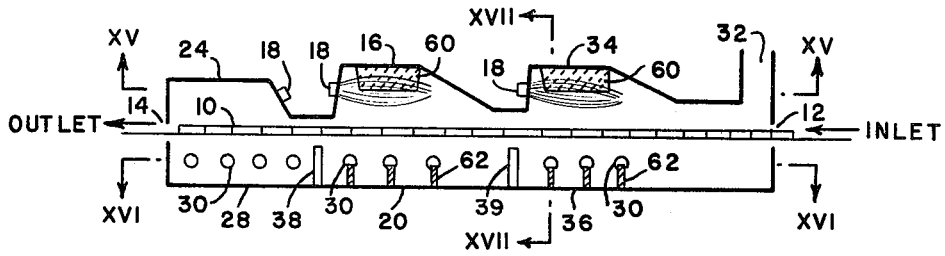
FIG. 14 is a sectional view showing the second embodiment of the six-zone continuous steel slab heating furnace to which the present invention is applied.
Figure 15:
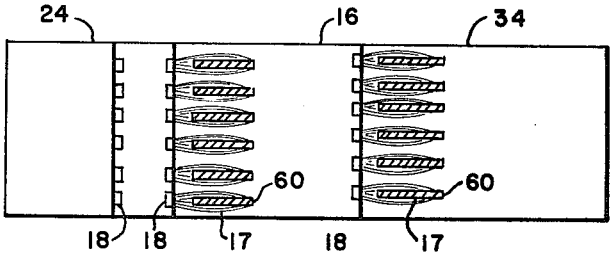
FIG. 15 is a sectional view taken along the line XV—XV in FIG. 14.
Figure 16:
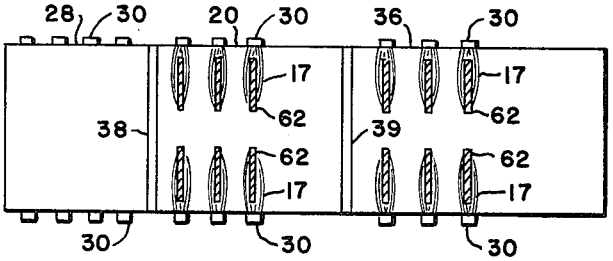
FIG. 16 is a sectional view taken along the line XVI—XVI in FIG. 14.
Figure 17:
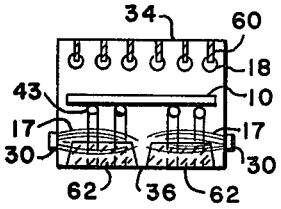
FIG. 17 is a sectional view taken along the line XVII—XVII in FIG. 14.

Various methods can be thought of in designing the shapes of heat-resistant materials 44 and installing them in the furnace. For example, like the modified examples shown in FIGS. 8 through 10, thin plate-like heat-resistant materials 50 made of fiberboard, for example, may be paralelly disposed and connected to one another with bar materials 52, or like ones shown FIGS. 11 through 13, a plurality of bar-like heat-resistant materials 54 made of fiberboard, for example, may be posted on the inner wall surface of the heating furnace. Since all of the above examples are heat transfer converters disposed in the heating zone 20, there have been shown the heat-resistant materials disposed on the furnace floor. However, the heat transmission converters disposed in the upper heating zone may be the heat-resistant materials similar to the above suspended from the ceiling. In addition, the requirements for a heat transfer converter are shown below.

(1) The shapes of combustion flames are not considerably deformed and diffusion combustion is not hampered.

(2) Since the combustion flames constitute a high temperature and high speed flow, the heat transfer converter should be able to withstand the high temperature and high speed flow. Additionally it is desirable for the heat transfer converter to have small thermal capacity.

(3) The surface of the heat-resistant material of the heat transfer converter should have a shape for facilitating convection heat transfer.

(4) Although it is desirable for the heat transfer converter to have an area of contact with combustion flames as large as possible, the requirement described in Item (1) above should be met and the view factor with the bodies to be heated should not be considerably worsened.

In an embodiment in which heat transfer converters are disposed in the upper and the lower heating zones like the present embodiment, the heat transfer converters further raise the temperatures at the high temperature portions of the upper and the lower heating zones through convection heat transfer from the high temperature and high speed flow of combustion flames and through radiation heat transfer from combustion flames, so that the heat pattern $H_2$ shown in FIG. 1 above can be attained, thereby improving the thermal efficiency in the heating zones.

Furthermore, the heat transfer converters are disposed only in the heating zones in the above case. However, in the case the soaking zone heating system is adopted, these heat transfer converters can be provided in the soaking zone. In this case, in the lower portion of the soaking zone, there are provided side burners, and hence, it is necessary to dispose the heat transfer converters in parallel to the width-wide direction of the furnace.

FIGS. 14 to 17 show the second embodiment of the present invention, which relates to the six-zone continuous steel slab heating furnace. The present embodiment differs from the first embodiment above in that an upper preheating zone 34 provided with axial flow type burners 18 and a lower preheating zone 36 provided with side burners 30 are provided in front of the upper heating zone 16 and of the lower heating zone 20, respectively, in the four-zone continuous steel slab heating furnace of the first embodiment, the burners of the lower heating zone 20 are made to be side burners 30, and the lower soaking zone 28 is divided from the lower heating zone 20 by a partition wall 38 and also the lower heating zone 20 is divided from the lower preheating zone 36 by a partition wall 39. As the result, the present embodiment differs from the first embodiment in that the heat transfer converters 60 in the upper heating zone 16 and the upper preheating zone 34 are paralelly disposed in the moving direction of the slabs 10, and the heat transfer converters 62 in the lower heating zone 20 and in the preheating zone 36 are disposed perpendicularly to the moving direction of the slabs 10. Other points are substantially identical with that of the first embodiment, and hence, description is omitted. In the present embodiment, it is possible to provide the heat transfer converters in the soaking zone similarly to the first embodiment, or the heat transfer converters to be provided in the upper zone can be partially omitted. The selection of the zones to be provided with heat transfer converters may be designed in accordance with the method of operating the specific heating furnace.

Figure 18:
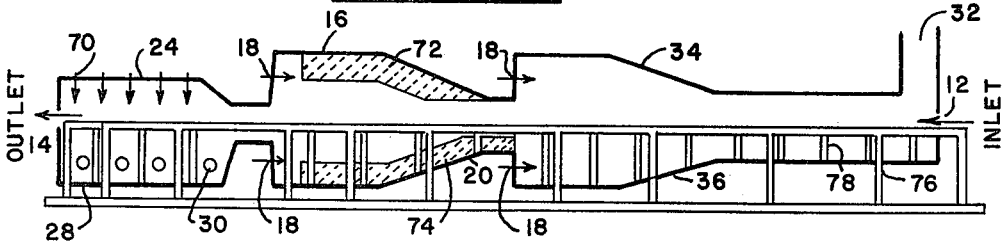
FIG. 18 is a sectional view showing the third embodiment of the six-zone continuous steel slab heating furnace with walking beams to which the present invention is applied.
Figure 25:
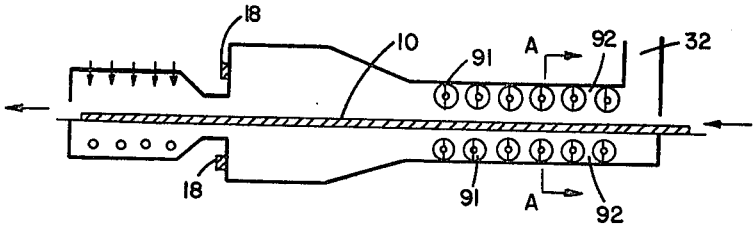
FIG. 25 is a sectional view showing an embodiment having a coil-like converters in the preheating zone.
Figure 26:
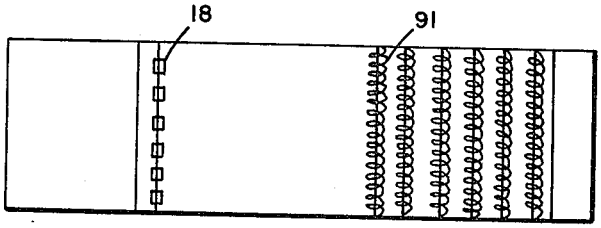
FIG. 26 is a plan view of the embodiment shown in FIG. 25.
Figure 27:
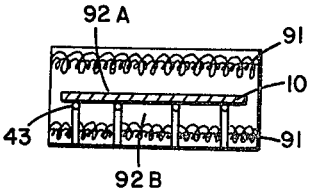
FIG. 27 is a sectional view of an embodiment shown in FIG. 25 taken along the line A—A.

FIG. 18 shows the third embodiment of the present invention, which relates to the six-zone continuous steel slab heating furnace with walking beams. The present embodiment differs from the first embodiment above in that an upper preheating zone 34 and lower preheating zone 36 both provided with axial flow type burners 18 without heat transfer converters are provided in front of the upper heating zone 16 and of the lower heating zone 20, respectively, in the four-zone continuous steel slab heating furnace of the first embodiment, the burners of the upper soaking zone 24 are made to be roof burners 70, the long type heat transfer converters 72 and 74 are disposed axially to reach nearly all surface of the ceiling or furnace floor. Designated at 76 are walking beams for conveying steel slabs 10, and 78 are stationary beams for holding steel slabs 10.

FIGS. 19 to 21 show the shapes and fixed positions of the heat transfer converters 72 attached to the ceiling.

FIGS. 22 to 24 show the suspending structure of heat transfer converters 72. These converters 72 are made of ceramic fiberboard. 80 which has T-shaped cross-section and T-shaped reinforcement 82 made of metal incorporated within the fiberboard 80. These converters 72 are inserted into the slits 84 of the ceiling 86 made of heat-resistant material from outer surface and suspended by the ceiling 86.

Further there will be discussed another group of embodiments which have their heat transfer converters equipped in the preheating zone of the furnace, in other words, in the downstream of the flame.

Figure 28:
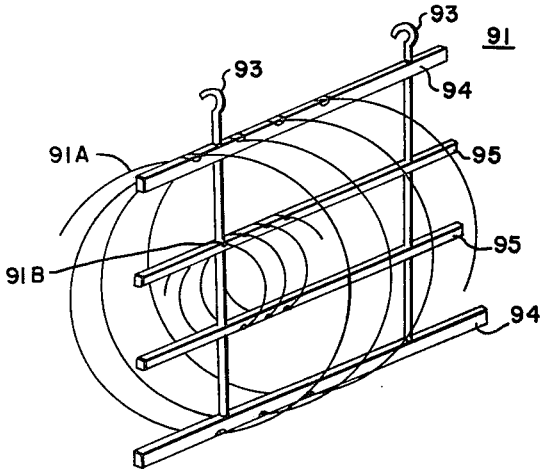
FIG. 28 is a perspective view of the converter of the embodiment shown in FIG. 25.

FIGS. 25 through 28 show an embodiment which has coil-like heat transfer converters 91 in the preheating zone 92 of the furnace. There are provided six coil-like heat transfer converters in the upper preheating zone 92A and the lower preheating zone 92B respectively. Each coil-like heat transfer converter has an outer coil 91A and an inner coil 91B which are made of heat resistant wire. The coils may also be made of thin pipes. As shown in FIG. 28, the outer coil 91A is held by a pair of beams 94 and the inner coil 91B is held by another pair of beams 95 such that those beams 94 and 95 are all fixed by means of spacers 15 to be suspended from the ceiling of the furnace. In this embodiment, the converters 91 have a double coil structure comprising an outer and innor coils 91A and 91B; however, a single, triple, other forms may also be applicable.

Figure 29:
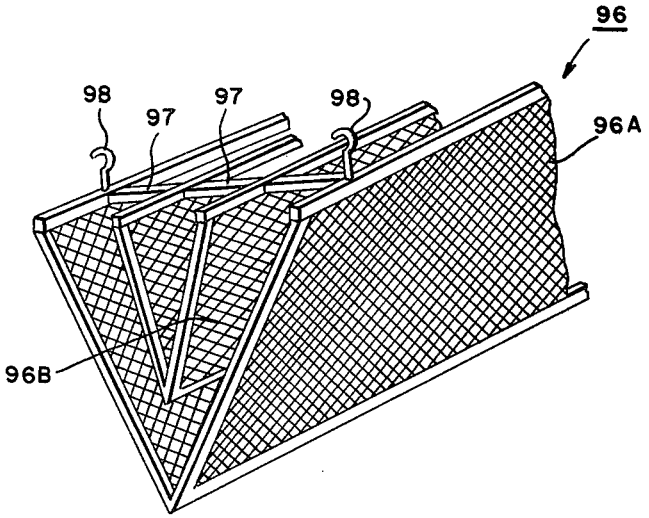
FIG. 29 is a perspective view showing another embodiment having a net-like converter.

FIG. 29 shows another embodiment of the second group. This embodiment has V-shaped net-like heat transfer converters 26 which comprises an outer converter 96A and inner converter 96B. Those outer and inner converters 96A and 96B are fixed together by spacers 97 and suspended from the ceiling with hooks 98.

FIGS. 31 through 34 show another embodiment of the second group, where there are provided eight plate-like heat transfer converters 98 made of steel in the upper and lower preheating zones respectively in the longitudinal direction. Those plate-like converters 98 are held by hooks 100 attached to spacers 99 which are connected to the ceiling with fasteners 101. The converters may also be made of ceramic fiberboard or other heat resistant materials.

Figure 30:
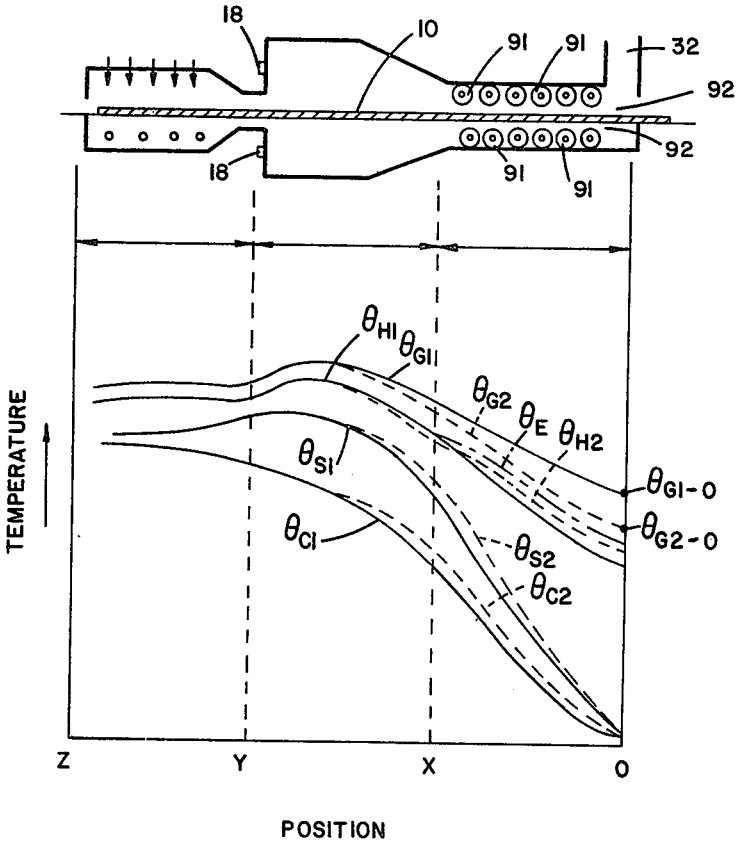
FIG. 30 is a sectional view of the embodiment shown in FIG. 25 and the temperature distribution in the furnace thereof.

FIG. 30 shows a structure of the present invention and its temperature distribution. As shown therein, the surface temperature $\theta S2$ and the center temperature $\theta C2$ of the steel slabs 10 are higher than the surface temperature $\theta S1$ and the center temperature $\theta C1$ respectively between the point O and the point x. This results from the fact that the heat transfer to the steel slabs 10 is increased. Accordingly, the inner surface temperature $\theta H2$ of the heating zones 16 and 20 can be reduced, which saves the consumption of the fuel. Between the gas burning temperature $\theta G1-x$ and $\theta G2-x$ at the point x, there is observed a relationship $\theta G1-x > \theta G2-x$. Further, there is observed a relationship $\theta G1-O > \theta G2-O$ between the exhaust gas temperatures. Further, the inner surface temperatures $\theta H1$ and $\theta H2$ have a relationship of $\theta H1 > \theta H2$ between the points x and y; however, between the points O and x, there is a relationship $\theta H1 < \theta H2$ because of the heat transfer converters 91. The temperatures $\theta E$ of the heat resitant material of the converters 14 has a relationship to $\theta H2$ and $\theta G2$ as $\theta H2 < \theta E < \theta G2$. Since there exist a relationship of $\theta H1 < \theta H2$ and $\theta G1-O < \theta G2-O$, the heat efficiency is improved in this invention.

In each of the embodiments described above, the present invention is applied to the continuous heating furnace. However, the scope of the application of the present invention is not limited to the above emdodiments. It is apparent that the present invention can be applied to a continuous heat treatment furnace, a continuous calcining furnace, a continuous reacting furnace and the like, in all of which bodies are heated by fuel combustion flames, or a batch type heating furnace, a batch type heat treatment furnace, a batch type calcining furnace, a batch type reacting furnace and the like, for example. Of course, the kind of the fuel is not limited to a gaseous fuel, but other fuels such as a liquefied fuel, and a solidified fuel may be used.

From the foregoing description, it should be apparent to one skilled in the art that the above-described embodiment is but one of many possible specific embodiments which can represent the applications of the principles of the present invention. Numerous and varid other arrangements can be readily devised by those skilled in the art without departing from the spirit and scope of the invention.

I claim:

1. A heating furnace for heating bodies by combustion flame comprising:

furnace tail preheating zones;

heating zones;

conveying means which moves said heating bodies longitudinally in the heating furnace;

furnace walls which cover said conveying means with said heating bodies;

burners which are attached to said furnace so as to heat said heating bodies by fuel combustion flames and which produce a flow of combustion flames in said longitudinal direction; and heat transfer converters disposed at furnace tail preheating zones and comprising plate-like heat resistant materials disposed parallel to the flow of combustion flames of said burners, wherein said heat transfer converters are heated through convection heat transfer from high temperature and high speed flow of the combustion flame to increase the radiation heat transfer to said heating bodies.

2. A heating furnace for heating bodies according to claim 1, wherein said heat transfer converters are provided in upper and lower preheating zones in a longitudinal direction of said furnace and parallel to said flow of combustion flames of said burners.

3. A preheating furnace according to claim 2, wherein said plate-like converters hang on hooks coupled to spacers which are coupled to a ceiling of said furnace by fasteners.

4. A heating furnace for heating bodies by fuel combustion flame as set forth in claim 1 characterized in that said heat transfer converter are made from heat resistant material having small thermal capacity and large heat transfer area.

5. A heating furnace for heating bodies by fuel combustion flame as set forth in claim 1 characterized in that said heat transfer converter are made from heat resistant material having high rate of surface radiation.

6. A heating furnace for heating bodies by fuel combustion flame as set forth in claim 1, characterized in that said plate-like heat resistant materials are made of ceramic fiberboard.

7. A heating furnace for heating bodies by fuel combustion flame as set forth in claim 1, characterized in that said plate-like heat resistant materials are made of steel plate.

* * * * *

UNITED STATES PATENT AND TRADEMARK OFFICE

CERTIFICATE OF CORRECTION

PATENT NO. : 4,266,932

DATED : May 12, 1981

INVENTOR(S) : YOSHIAKI SHINOHARA

It is certified that error appears in the above—identified patent and that said Letters Patent is hereby corrected as shown below:

At [30] Foreign Application Priority Data, add "Mar. 20, 1978 [JP] Japan.....53-30937".

Signed and Sealed this

*First* Day of *September 1981*

[SEAL]

*Attest:*

GERALD J. MOSSINGHOFF

*Attesting Officer*

*Commissioner of Patents and Trademarks*